US012152587B2

(12) United States Patent
Kolyshkin et al.

(10) Patent No.: US 12,152,587 B2
(45) Date of Patent: Nov. 26, 2024

(54) MUD MOTOR OR PROGRESSIVE CAVITY PUMP WITH VARYING PITCH AND TAPER

(71) Applicant: Schlumberger Technology Corporation, Sugar Land, TX (US)

(72) Inventors: Anton Kolyshkin, Katy, TX (US); Maxim Pushkarev, Edmonton (CA); Samba Ba, Beijing (CN); Li Guo, Katy, TX (US); Robert Little, Katy, TX (US); Geoffrey Charles Downton, Stonehouse (GB)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 29 days.

(21) Appl. No.: 17/595,287

(22) PCT Filed: May 14, 2020

(86) PCT No.: PCT/US2020/032852
§ 371 (c)(1),
(2) Date: Nov. 12, 2021

(87) PCT Pub. No.: WO2020/232231
PCT Pub. Date: Nov. 19, 2020

(65) Prior Publication Data

US 2022/0364559 A1 Nov. 17, 2022

Related U.S. Application Data

(60) Provisional application No. 62/847,531, filed on May 14, 2019.

(51) Int. Cl.

| | |
|---|---|
| ***F04C 2/107*** | (2006.01) |
| ***F04C 13/00*** | (2006.01) |
| ***F04C 18/107*** | (2006.01) |

(52) U.S. Cl.
CPC ..... *F04C 2/107* (2013.01); *F04C 2/1075* (2013.01); *F04C 13/001* (2013.01);
(Continued)

(58) Field of Classification Search
CPC ..... F04C 2/084; F04C 2/107; F04C 2/1071; F04C 2/1075; F04C 2/16; F04C 13/001;
(Continued)

(56) References Cited

U.S. PATENT DOCUMENTS 2,957,427 A 10/1960 O'Connor
3,139,035 A 6/1964 O'Connor
(Continued)

FOREIGN PATENT DOCUMENTS

GB 1354146 A * 5/1974 ..... B29C 47/38
GB 2597952 A * 2/2022 ..... F04C 18/22
WO WO-2020051692 A1 * 3/2020 ..... F01C 1/04

OTHER PUBLICATIONS

International Preliminary Report on Patentability issued in International Patent application PCT/US2020/032852 on Nov. 25, 2021, 11 pages.
(Continued)

*Primary Examiner* — Theresa Trieu
(74) *Attorney, Agent, or Firm* — Bryan K. Adams

(57) ABSTRACT

A mud motor includes a rotor and a stator. Drilling fluid received by cavities of the mud motor drives the rotor to rotate within the stator. The rotor includes one or more rotor lobes extending helically and defining a rotor pitch. The stator includes two or more stator lobes extending helically and defining a stator pitch. The rotor and the stator together define a tapered profile of the mud motor that varies proceeding from a top end of the mud motor to a bottom end of the mud motor. At least one of the rotor pitch or the stator
(Continued)

pitch vary as proceeding from the top end of the mud motor to the bottom end of the mud motor.

10 Claims, 8 Drawing Sheets

(52) U.S. Cl.
CPC ..... *F04C 18/1075* (2013.01); *F04C 2240/10* (2013.01); *F04C 2240/20* (2013.01)

(58) Field of Classification Search
CPC .. F04C 18/1075; F04C 18/16; F04C 2240/10; F04C 2240/20; F01C 1/101; E21B 4/02
See application file for complete search history.

(56) References Cited

U.S. PATENT DOCUMENTS

| | | | | |
|---|---|---|---|---|
| 4,187,061 | A | 2/1980 | Jurgens | |
| 5,679,894 | A | 10/1997 | Kruger et al. | |
| 5,722,820 | A | 3/1998 | Wild et al. | |
| 6,358,027 | B1 | 3/2002 | Lane | |
| 6,457,958 | B1 * | 10/2002 | Dunn | F04C 2/1071 418/48 |
| 8,556,603 | B2 | 10/2013 | Ree | |
| 8,888,474 | B2 | 11/2014 | Grimmer | |
| 9,109,595 | B2 | 8/2015 | Daunheimer | |
| 9,360,009 | B2 | 6/2016 | Coppen | |
| 9,869,126 | B2 | 1/2018 | Evans | |
| 10,227,978 | B2 | 3/2019 | Sakakihara et al. | |
| 10,233,921 | B2 | 3/2019 | Sakakihara et al. | |
| 10,233,922 | B2 | 3/2019 | Sakakihara et al. | |
| 10,364,813 | B2 | 7/2019 | Sakakihara et al. | |
| 10,450,800 | B2 | 10/2019 | Clouzeau et al. | |
| 10,458,240 | B2 | 10/2019 | Purcell et al. | |
| 10,612,542 | B2 | 4/2020 | Jarvis et al. | |
| 10,626,866 | B2 | 4/2020 | Ba et al. | |
| 2010/0260636 | A1 * | 10/2010 | Grann | F04C 2/1071 418/48 |
| 2012/0132470 | A1 | 5/2012 | Jarvis et al. | |
| 2015/0354280 | A1 * | 12/2015 | Downton | E21B 4/02 175/107 |
| 2016/0040480 | A1 | 2/2016 | Evans | |
| 2017/0314551 | A1 | 11/2017 | Sakakihara et al. | |
| 2018/0003174 | A1 | 1/2018 | Ba et al. | |
| 2018/0003175 | A1 | 1/2018 | Pushkarev et al. | |
| 2018/0266181 | A1 | 9/2018 | Gawski et al. | |
| 2019/0093654 | A1 | 3/2019 | Krpec et al. | |
| 2019/0145374 | A1 | 5/2019 | Parhar et al. | |
| 2020/0256311 | A1 | 8/2020 | Parhar et al. | |
| 2021/0025392 | A1 | 1/2021 | Montie | |

OTHER PUBLICATIONS

International Search Report and Written Opinion issued in International Patent application PCT/US2020/032852 on Aug. 20, 2020, 15 pages.

* cited by examiner

MUD MOTOR OR PROGRESSIVE CAVITY PUMP WITH VARYING PITCH AND TAPER

CROSS-REFERENCE TO RELATED APPLICATIONS

This application is the U.S. national phase of International Patent Application No. PCT/US2020/032852, filed May 14, 2020, and entitled "MUD MOTOR OR PROGRESSIVE CAVITY PUMP WITH VARYING PITCH AND TAPER," which claims the benefit of, and priority to, U.S. Patent Application No. 62/847,531 filed on May 14, 2019, which is incorporated herein by this reference in its entirety.

BACKGROUND

Mud motors are used to convert energy stored in drilling fluid into mechanical, rotational energy. Mud motors are often used in connection with a bottom hole assembly. The rotational energy can be converted to electrical energy, so as to power downhole devices and/or can be used directly to rotate drilling equipment.

One standard design for a mud motor is a progressive cavity or Moineau motor. Such mud motors generally include a rotor that is positioned within a stator. The rotor and stator have generally helical lobes, which form the cavities therebetween, and the cavities progresses axially as the rotor rotates within the stator. The rotor thus rotates eccentrically within the stator, and is often coupled to a constant-velocity (CV) joint or another type of flexible coupling to accommodate the eccentric motion.

Further, the stator may be formed at least partially from an elastomeric material, such as a rubber. Such elastomeric material may be a common source of failure, or otherwise limit the lifecycle of the mud motor.

BRIEF DESCRIPTION OF THE DRAWINGS

The accompanying drawings, which are incorporated in and constitute a part of this specification, illustrate embodiments of the present teachings and together with the description, serve to explain the principles of the present teachings. In the figures.

DETAILED DESCRIPTION

Reference will now be made in detail to embodiments, examples of which are illustrated in the accompanying drawings and figures. In the following detailed description, numerous specific details are set forth in order to provide a thorough understanding of the invention. However, it will be apparent to one of ordinary skill in the art that the invention may be practiced without these specific details. In other instances, well-known methods, procedures, components, circuits and networks have not been described in detail so as not to unnecessarily obscure aspects of the embodiments.

It will also be understood that, although the terms first, second, etc. may be used herein to describe various elements, these elements should not be limited by these terms. These terms are only used to distinguish one element from another. For example, a first object could be termed a second object, and, similarly, a second object could be termed a first object, without departing from the scope of the invention. The first object and the second object are both objects, respectively, but they are not to be considered the same object.

The terminology used in the description of the invention herein is for the purpose of describing particular embodiments only and is not intended to be limiting of the invention. As used in the description of the invention and the appended claims, the singular forms "a," "an" and "the" are intended to include the plural forms as well, unless the context clearly indicates otherwise. It will also be understood that the term "and/or" as used herein refers to and encompasses any possible combinations of one or more of the associated listed items. It will be further understood that the terms "includes," "including," "comprises" and/or "comprising," when used in this specification, specify the presence of stated features, integers, steps, operations, elements, and/or components, but do not preclude the presence or addition of one or more other features, integers, steps, operations, elements, components, and/or groups thereof. Further, as used herein, the term "if" may be construed to mean "when" or "upon" or "in response to determining" or "in response to detecting," depending on the context.

Attention is now directed to processing procedures, methods, techniques and workflows that are in accordance with some embodiments. Some operations in the processing procedures, methods, techniques and workflows disclosed herein may be combined and/or the order of some operations may be changed.

Figure 1:
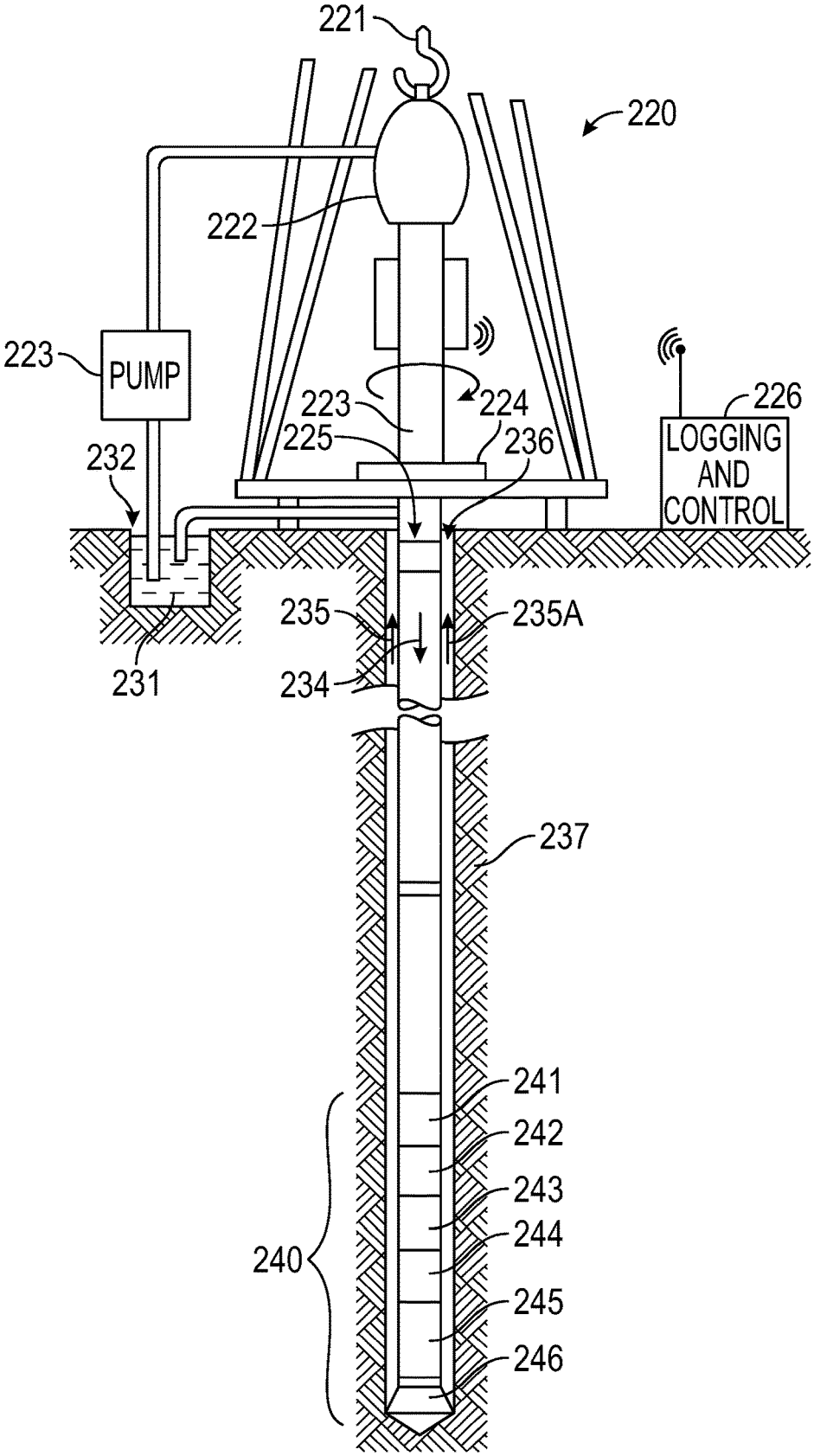
FIG. 1 illustrates a schematic view of an example of a wellsite system, according to an embodiment.

FIG. 1 illustrates a wellsite system according to an embodiment. The wellsite can be onshore or offshore. In this example system, a borehole is formed in subsurface formations by rotary drilling in a manner that is well known. A drill string 225 is suspended within a borehole 236 and has a bottom hole assembly (BHA) 240 which includes a drill bit 246 at its lower end. A surface system 220 includes platform and derrick assembly positioned over the borehole 236, the assembly including a rotary table 224, kelly (not shown), hook 221, and rotary swivel 222. The drill string 225 is rotated by the rotary table 224 energized by means not shown, which engages the kelly (not shown) at the upper end of the drill string 225. The drill string 225 is suspended from the hook 221, attached to a traveling block (also not shown), through the kelly (not shown) and the rotary swivel 222 which permits rotation of the drill string 225 relative to the hook 221. As is well known, a top drive system could be used instead of the rotary table system shown in FIG. 1.

In the illustrated example, the surface system further includes drilling fluid or mud 232 stored in a pit 231 formed at the well site. A pump 233 delivers the drilling fluid to the interior of the drill string 225 via a port (not shown) in the swivel 222, causing the drilling fluid to flow downwardly through the drill string 225 as indicated by the directional arrow 234. The drilling fluid exits the drill string via ports (not shown) in the drill bit 246, and then circulates upwardly through an annulus region 235 between the outside of the drill string 225 and the wall of the borehole 236, as indicated by the directional arrows 235 and 235A. In this manner, the drilling fluid lubricates the drill bit 246 and carries formation cuttings up to the surface as it is returned to the pit 231 for recirculation.

The BHA 240 of the illustrated embodiment may include a measuring-while-drilling (MWD) tool 241, a logging-while-drilling (LWD) tool 244, a rotary steerable directional drilling system 245 and/or a motor, and the drill bit 246. It will also be understood that more than one LWD tool and/or MWD tool can be employed, e.g. as represented at 243. In some embodiments, drilling fluid routed through cavities of the motor 245 rotates the drill bit 246.

The LWD tool 244 is housed in a special type of drill collar, as is known in the art, and can contain one or a plurality of known types of logging tools. The LWD tool 244 may include capabilities for measuring, processing, and storing information, as well as for communicating with the surface equipment. In the present example, the LWD tool 244 may any one or more well logging instruments known in the art, including, without limitation, electrical resistivity, acoustic velocity or slowness, neutron porosity, gamma-gamma density, neutron activation spectroscopy, nuclear magnetic resonance and natural gamma emission spectroscopy.

The MWD tool 241 is also housed in a special type of drill collar, as is known in the art, and can contain one or more devices for measuring characteristics of the drill string and drill bit. The MWD tool 241 further includes an apparatus 242 for generating electrical power to the downhole system. This may typically include a mud turbine generator powered by the flow of the drilling fluid, it being understood that other power and/or battery systems may be employed. In the present embodiment, the MWD tool 241 may include one or more of the following types of measuring devices: a weight-on-bit measuring device, a torque measuring device, a vibration measuring device, a shock measuring device, a stick slip measuring device, a direction measuring device, and an inclination measuring device. The power generating apparatus 242 may also include a drilling fluid flow modulator for communicating measurement and/or tool condition signals to the surface for detection and interpretation by a logging and control unit (e.g., a "controller") 226.

Figure 2:
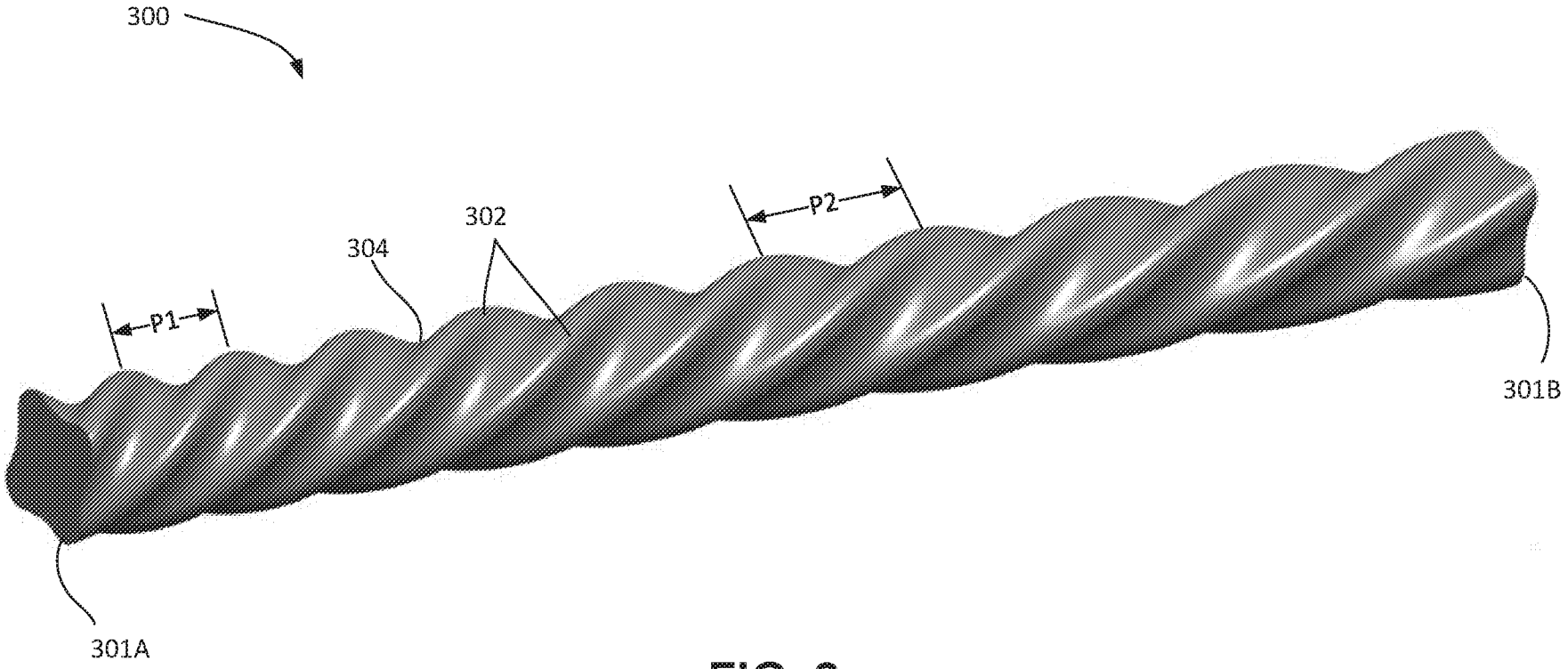
FIG. 2 illustrates a perspective view of a rotor with a varying pitch length, according to an embodiment.

FIG. 2 illustrates a perspective view of a rotor 300 for a mud motor (e.g., the mud motor 245) (specifically for a power section thereof), according to an embodiment. The rotor 300 may have an upper end 301A, a lower end 301B, and a plurality of lobes 302 (four are shown) extending radially outward from a plurality of valleys 304 therebetween. Further, the lobes 302 may extend generally helically along the central, longitudinal axis of the rotor 300, e.g., all or part of the way between the upper and lower ends 301A, 301B. The rotor pitch length may be the number of peaks along an axial cross-section multiplied by the length of the axial cross-section. Alternatively, it may be defined as axial advance of a helix during one complete turn. Thus, the pitch of the rotor may correspond to the definition of lead commonly used to describe screw threads. By contrast, the rotor sub-pitch length of the rotor 300 may be the distance between corresponding points on two adjacent lobes 302 (e.g., peak-to-peak) when viewed along an axial cross-section. For example, the pitch along a portion of an axis of a rotor with four lobes may be approximated as the sum of the four sub-pitches along the same portion of the axis. The rotor and the stator are configured to define one or more cavities along the length of the mud motor between the outer face of the rotor and the inner face of the stator. Each cavity may have a helical shape formed around the rotor, and a length of each cavity may be approximately equal to a pitch length.

As shown, the pitch of the rotor 300 (defined by the geometry of the lobes 302) may increase as proceeding from the upper end 301A to the lower end 301B. In other words, the lobes 302 progressively cover a greater axial distance for each angular increment. As indicated, for example, a sub-pitch length P1 near the upper end 301A may be less than the sub-pitch length P2 closer to the lower end 301B (P1<P2). In the illustrated embodiment, the pitch increase is linear. In other embodiments, the pitch increase may be non-linear, e.g., according to any relationship between the axial position between the upper end 301A and the lower end 301B. The pitch may vary by any amount. In practical terms, however, the lower bounds of effective pitch variation may be related to the tolerancing of the rotor 300 and stator. In some embodiments, the pitch may thus be varied by at least about 0.2% or about 0.5% of the initial pitch length at the top end 301A. In some embodiments, the highest effective pitch variation may be constrained by the ability of the rotor 300 to continue to operate in a given stator, e.g., without modifying the stator pitch. Thus, for example, the pitch may vary by up to about 10% of the initial pitch length; however, this value might be different in various applications.

In some embodiments, the pitch of the stator may be varied, in similar fashion to the variation of the stator lobes 302 discussed herein. In some embodiments, the stator pitch length may be varied in lieu of varying the rotor lobe 302 pitch. In still other embodiments, both the pitch length of the stator and the pitch length of the rotor lobes 302 may be varied.

Without being bound by theory, increasing the pitch may decrease local pressure differential, i.e., the difference between the minimum pressure and maximum pressure experienced between adjacent cavities at a given location along the mud motor. In conventional mud motors, the local pressure differential generally increases as proceeding toward the lower end 301B, caused by torsion in the rotor 300, stator, and the drilling fluid's compressibility. Thus, by progressively (for example) increasing pitch of the lobes 302, the local pressure differential may become more consistent, narrowing the range of the local pressure differential. Furthermore, at pressures and temperatures seen in wellbore applications, performance may be minimally, if at all, impacted. The wear life, on the other hand, may be increased, potentially dramatically.

To explain further, unequal pressure differential along the mud motor may yield geometrical deformation in the cavities formed between the stator and the rotor 300. In particular, higher intercavity pressure drop may yield increase deformation in the rotor 300 and stator, and thus the cavity. The higher deformation may lower the fatigue life of the mud motor. Further, higher deformation can yield higher hysteresis heat build-up, which in turn can increase the "fit" (increasing the interference between the rotor and stator). Increasing fit may in turn cause higher intercavity pressure, which may thus result in a positive feedback loop, as higher intercavity pressure drop increases fit which increases intercavity pressure drop.

The variable pitch may mitigate such a feedback situation by reducing elastomer deformation in locations where they reach their maximums otherwise. The variable pitch length can be selected to narrow the differential pressure distribution (e.g., such that the pressure differential at the top (inlet) end 301A is closer to the pressure differential at the lower (outlet) end 301B). Further, the deformed cavity volume can be used for the pitch length selection of the length of the mud motor. Thus, strain and hysteresis distribution may be equalized, relative to rotors/stators without pitch variation. In some embodiments, maximum strain and hysteresis heat build-up can be reduced by about 7-8% up to about 15% or more, which may result in 60-70% or more increase in elastomer fatigue life and/or increasing pressure rating by about 20% or more. The particular pitch variation can be adjusted to maximize the effect for differential ranges expected in different applications and, as mentioned above, more complex, e.g., non-linear pitch variation can be used to further increase reliability. For example, performance, strain, heat build-up, and pressure differential, may be modeled for a given pressure and temperature. Accordingly, the pitch relationship/variation can be selected to enhance one or more desired variables, e.g., performance and/or elastomer durability.

Figure 3:
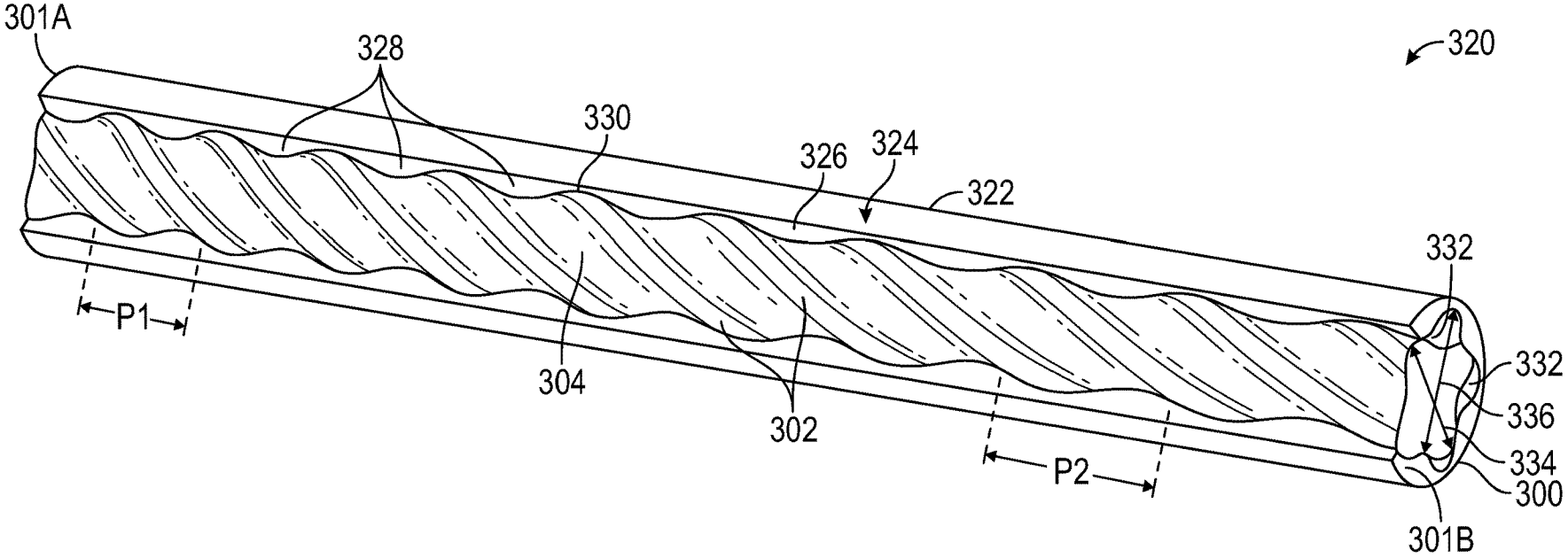
FIG. 3 illustrates an embodiment of a mud motor with a rotor and a stator having an increasing pitch length.

FIG. 3 illustrates a perspective view of an embodiment of a mud motor 320 with a portion of a stator 322 removed to show the rotor 300 disposed therein. A housing 324 of the stator 322 at least partially encloses a stator liner 326, which may include an elastomeric material, such as a rubber. Multiple lobes 328 extend radially inward from a plurality of valleys 330 therebetween. As is appreciated, the number of stator lobes 328 is greater than the number of rotor lobes 302, thereby forming helical cavities 332 that proceed along the mud motor 320 as the rotor 300 rotates within the stator 322. Adjusting the pitch of the lobes of the rotor 302 and/or the stator 322 affects the volume of the cavities 332. While FIG. 3 illustrates the pitch of both the rotor 300 and the stator 320 increasing from the sub-pitch length P1 near the top end 301A to the sub-pitch length P2 near the bottom end 301B, some embodiments of the mud motor 320 may vary the pitch length of only the rotor 300 (as illustrated in FIG. 2), or only the stator 320. The flexibility of the elastomeric material of the stator liner 326 may facilitate changes to the pitch length of only the rotor 300 or the stator 320. As described above, the relationship that defines the pitch along the length of the mud motor 320 may be a linear relationship or a non-linear relationship. In some embodiments, adjustments to the pitch length of only the rotor 300 or the stator 320 may compensate for changes to the cavity volumes by the downhole operating conditions (e.g., temperature, pressure, torque) on the mud motor 320.

Increasing the pitch from the top end 301A to the bottom end 301B without other changes to the mud motor 320 may increase the volume of the cavities 332 that are progressed along the length of the mud motor 320 when the rotor 300 rotates. Increasing the cavity volume along the length of the mud motor may narrow the differential pressure distribution between the top end 301A and the bottom end 301B. Narrowing the differential pressure distribution may increase the fatigue life of the elastomer in the mud motor. Additionally, or in the alternative, increasing the cavity volume along the length of the mud motor 320 may reduce or eliminate pressure spikes along the length of the mud motor 320 due to issues such as tolerancing of the mud motor components and temperature effects (e.g., swelling) of the stator liner 326 or the rotor 300. As discussed herein, increasing the cavity volume along the length of the mud motor may include increases of 0.5%, 1%, 3%, or 5%.

Figure 4:
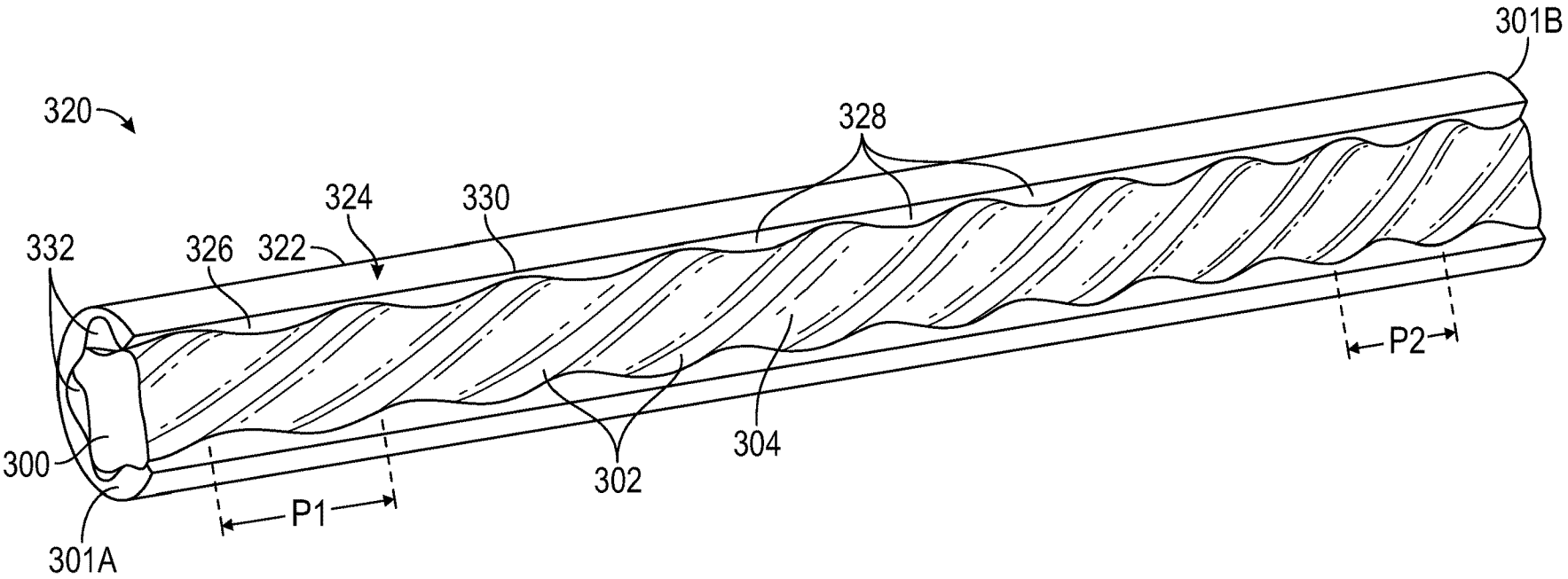
FIG. 4 illustrates an embodiment of a mud motor with a rotor and a stator having a decreasing pitch length.

FIG. 4 illustrates a perspective view of an embodiment of the mud motor 320 with a decreasing pitch from the top end 301A to the bottom end 301B. Decreasing the pitch from the top end 301A to the bottom end 301B without other changes to the mud motor 320 may decrease the volume of the cavities 332 that are progressed along the length of the mud motor 320 as the rotor 300 rotates. The elastomeric stator liner 326 may facilitate controlled fluid leakage between the cavities 332 along the mud motor 320. Decreasing the cavity volume along the length of the mud motor 320 may increase the pressure of the working fluid routed through the mud motor. This may increase the efficiency of mud motors driven by compressible fluids, such as foams or fluids with dissolved or entrained gases. As discussed herein, decreasing the cavity volume along the length of the mud motor may include decreases of 0.5%, 1%, 3%, or 5%.

The shape of the components of the mud motor 320 affects the cavities 332 formed between the rotor 300 and the stator 320. Factors of the shape that affect the cavities 332 that progress through the mud motor with rotation of the rotor include the pitch of the lobes, the profile of the lobes, the fit of the components (i.e., degree of any interference fit), and a taper profile of the mud motor. FIGS. 3 and 4 illustrate embodiments of the mud motor 320 with varied pitch and no tapering of the profile of the mud motor components. That is, a rotor diameter 334 (e.g., major rotor diameter) and a stator diameter 336 (e.g., major stator diameter) do not vary from the top end 301A to the bottom end 301B. The cavities 332 proximate the top end 301A of the mud motor 320 shown in FIGS. 3 and 4 have different volumes than the cavities 332 proximate the bottom end 301B.

Figure 5:
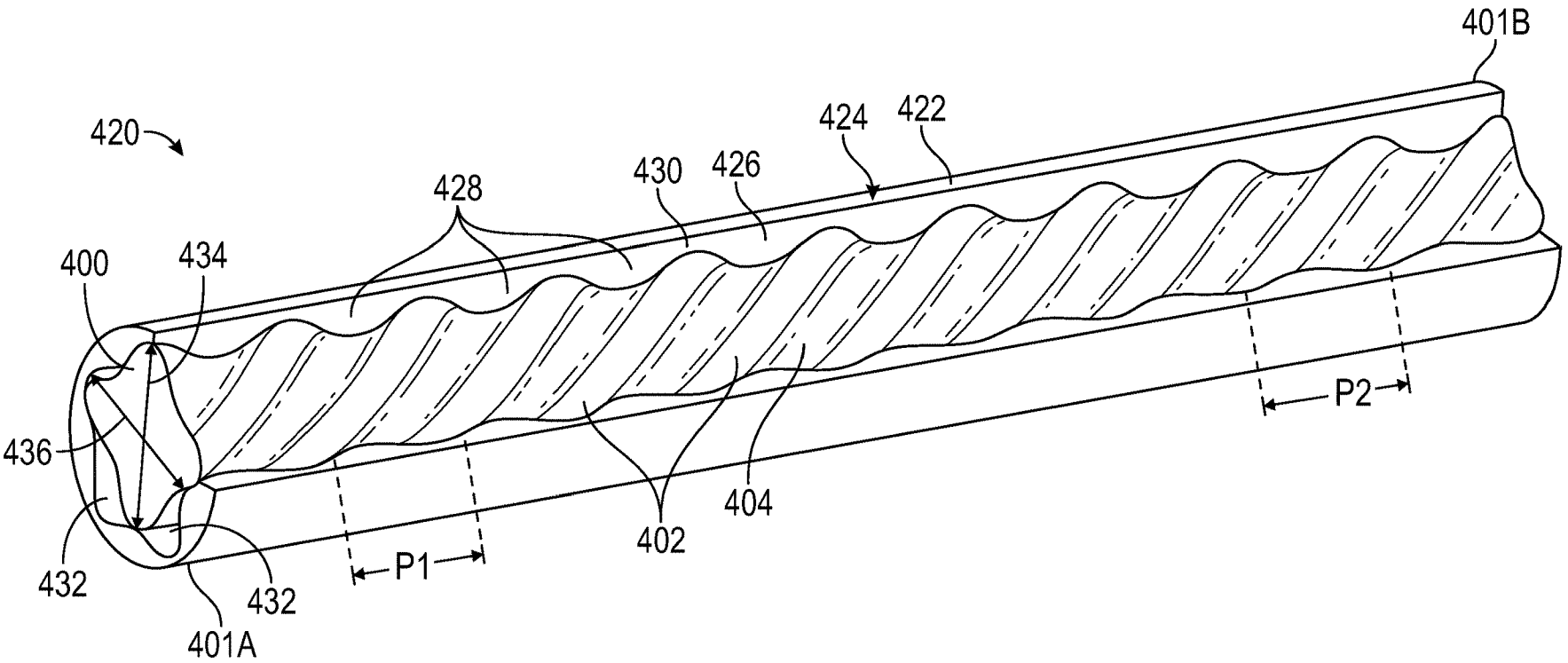
FIG. 5 illustrates an embodiment of a mud motor with a tapered profile and a constant pitch length.

FIG. 5 illustrates an embodiment of a mud motor 420 (e.g., the mud motor 245) with a tapered profile and a constant pitch. As discussed herein, a tapered profile is defined as a mud motor 420 with a stator 422 that changes (e.g., narrows, widens) from the top end 401A of the stator 422 to the bottom end 401B of the stator 422, and a rotor 400 that changes inversely of the stator 422 from the top end 401A of the rotor 400 to the bottom end 401B of the rotor 400. A tapered profile that narrows from the top end 401A to the bottom end 401B has larger major diameters of the stator 422 and the rotor 400 at the top end 401A than at the bottom end 401B. In contrast, a tapered profile that widens from the top end 401A to the bottom end 401B has smaller major diameters of the stator 422 and the rotor 400 at the top end 401A than at the bottom end 401B. FIGS. 5-10 illustrate embodiments of mud motors having tapered profiles.

Returning to FIG. 5, the sub-pitch length P1 of the lobes of the rotor 400 and the stator 420 near the top end 401A of the mud motor 420 is equal to the sub-pitch length P2 near the bottom end 401B of the mud motor 420. The rotor diameter 434 and the stator diameter 436 are larger at the top end 401A than at the bottom end 401B of the mud motor 420. This tapered profile of the mud motor 420 may decrease the volume of the cavities 432 along the length of the mud motor 420.

Figure 6:
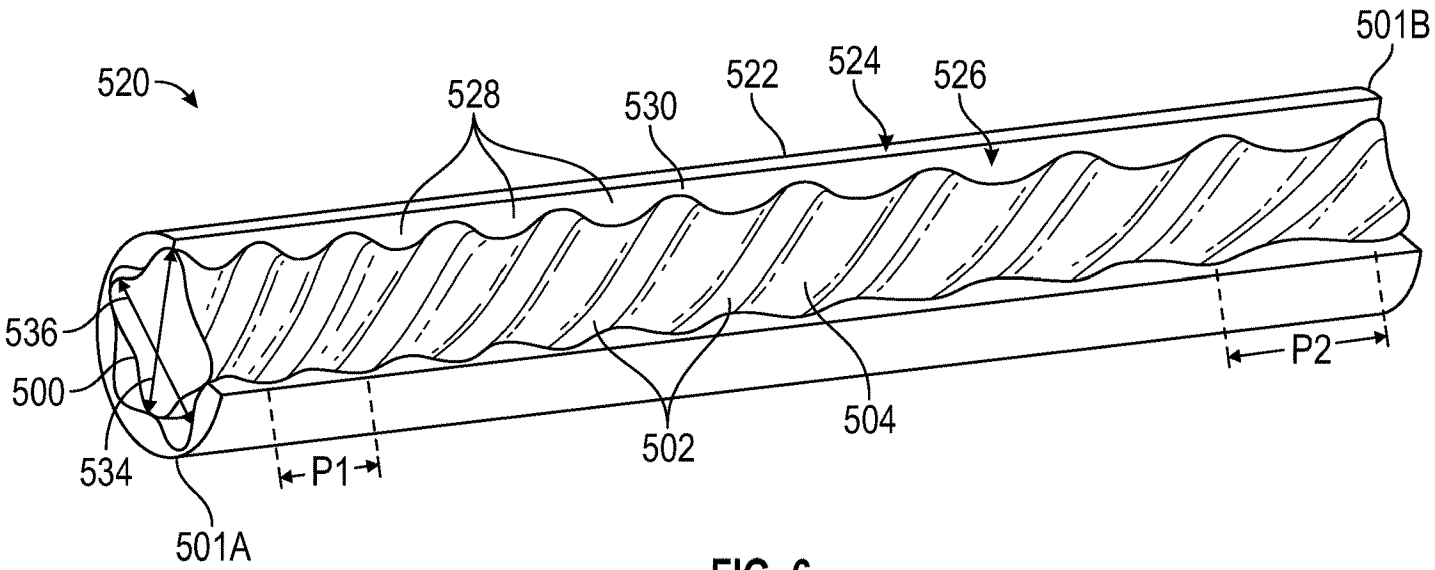
FIG. 6 illustrates an embodiment of a mud motor having a tapered profile and an increasing pitch length.
Figure 7:
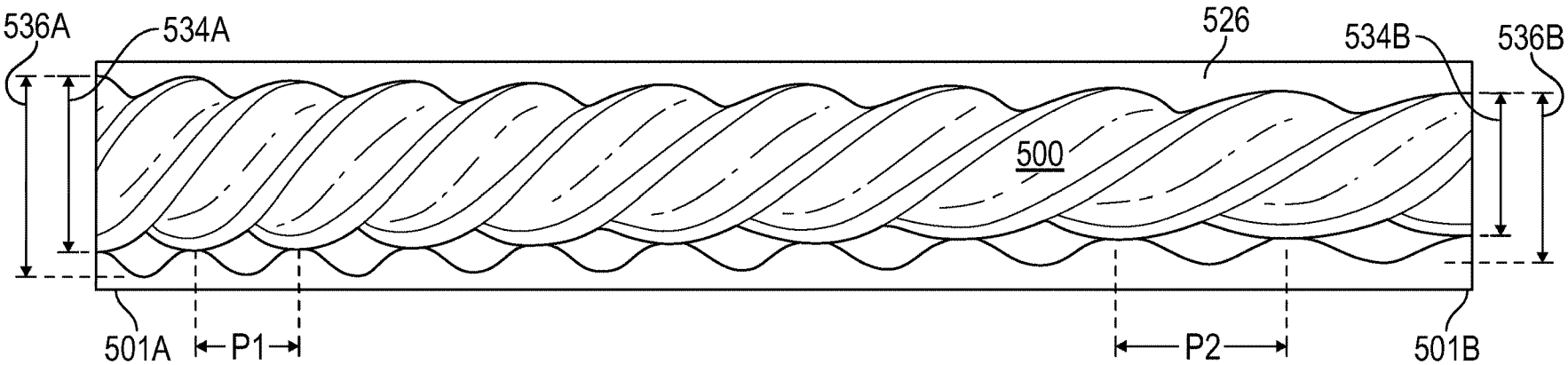
FIG. 7 illustrates an embodiment of a mud motor having a tapered profile and an increasing pitch length.

FIGS. 6-9 illustrate embodiments of the mud motor with various arrangements of the pitch and the taper profile that may affect the volume of the cavities from the top end 501A to the bottom end 501B. Through control of the pitch and the taper profile along the mud motor 520, the cavities may be controlled to have increasing, decreasing, or constant volumes between the top end 501A and the bottom end 501B. As discussed above with FIG. 3, increasing the pitch alone may increase the volume of the cavities along the mud motor 520. Tapering the profile of the mud motor 520 from the top end 501A to the bottom end 501B, as shown in FIGS. 6 and 7, may enable the volume of the cavities 536 to remain substantially equal or decrease along the length of the mud motor 520. For example, the major stator diameter 536A and the major rotor diameter 534A at the top end 501A may be larger than the major stator diameter 536B and the major rotor diameter 534B at the bottom end 501B, yet the sub-pitch length P1 near the top end 501A may be less than the sub-pitch length P2 near the bottom end 501B. In some embodiments, tapering the profile of the mud motor 520 from the top end 501A to the bottom end 501B may enable the volume of the cavities 536 to increase along the length of the mud motor 520. The increase in the volume of the cavities 536 progressed from the top end 501A to the bottom end 501B may be between 0.1% to 10%, 0.5% to 8%, or 1% to 5%. This increase in the volume of the cavities 536 may reduce the pressure of the drilling fluid therein, and may increase the fatigue life of the elastomer in the mud motor.

In some embodiments, the pitch of the rotor and the pitch of the stator may be covariable axially. That is, the pitch of the rotor and the pitch of the stator may be related to each other and may be based at least in part on axial position along the mud motor 520 between the top end 501A and the bottom end 501B. Additionally, or in the alternative, the pitch of the rotor and the pitch of the stator may be covariable with the angle of the taper along the mud motor 520. For example, to maintain a constant volume within cavities defined by the rotor and the stator, the pitch of the rotor and the pitch of the stator may increase towards the tapered (e.g., narrowed) end 501B of the stator 522. Maintaining the constant volume or an increased volume along the length of the mud motor 520 may reduce or eliminate incidences of hydraulic lockup when an incompressible fluid is routed through the mud motor. As discussed herein, a constant volume may be defined as a volume within a cavity that varies less than 0.1%, less than 0.5%, or less than 1% as the cavity progresses through the mud motor 520.

Through controlling the pitches of the stator 522 and the rotor 500 as covariables, the kinematics of the stator and rotor may remain uncompromised along the length of the mud motor 520. Controlling the pitch of the stator and the pitch of the rotor as covariables may decrease the deformation and wear of the elastomeric liner relative to changing only the pitch of the rotor or the pitch of the stator. This may increase the fatigue life of the elastomeric liner. The tapered profile of the stator and the rotor may also facilitate changing the fit of the components via axial movement of the rotor relative to the stator as discussed below.

Figure 8:
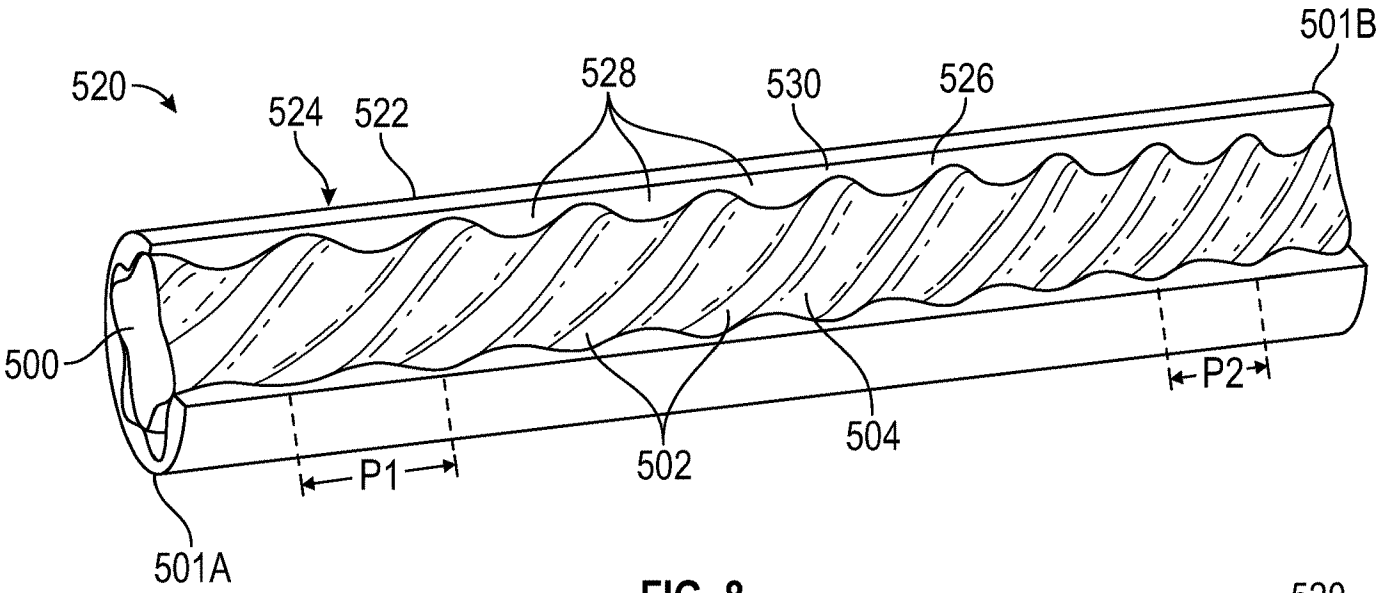
FIG. 8 illustrates an embodiment of a mud motor having a tapered profile and a decreasing pitch length.
Figure 9:
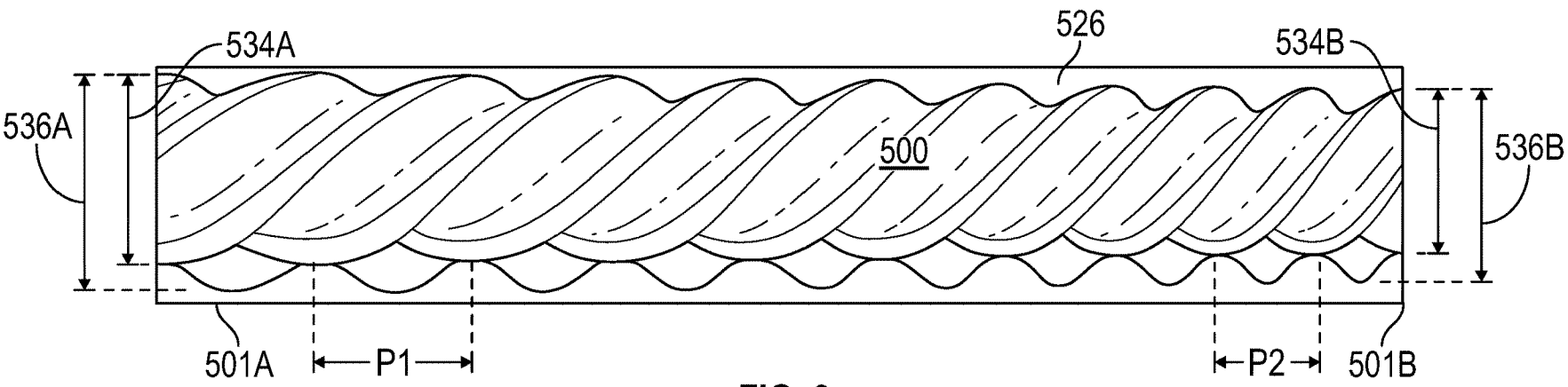
FIG. 9 illustrates an embodiment of a mud motor having a tapered profile and a decreasing pitch length.

Tapering the profile of the mud motor 520 from the top end 501A to the bottom end 501B while also decreasing the pitch of the stator and the rotor, as shown in FIGS. 8 and 9, may enable the volume of the cavities 536 to be decreased along the length of the mud motor 520. For example, the major stator diameter 536A and the major rotor diameter 534A at the top end 501A may be larger than the major stator diameter 536B and the major rotor diameter 534B at the bottom end 501B, and the sub-pitch length P1 near the top end 501A may be greater than the sub-pitch length P2 near the bottom end 501B. The decrease in the volume of the cavities 536 progressed from the top end 501A to the bottom end 501B may be between 0.1% to 10%, 0.5% to 8%, or 1% to 5%. Decreasing the volume of the cavities via reducing the pitch and tapering rotor and stator of the mud motor may increase the pressure of the working fluid routed through the mud motor or a progressive cavity pump (PCP). This may increase the efficiency of mud motors driven by compressible fluids or PCPs driving compressible fluids, such as foams or fluids with dissolved or entrained gases.

Figure 10:
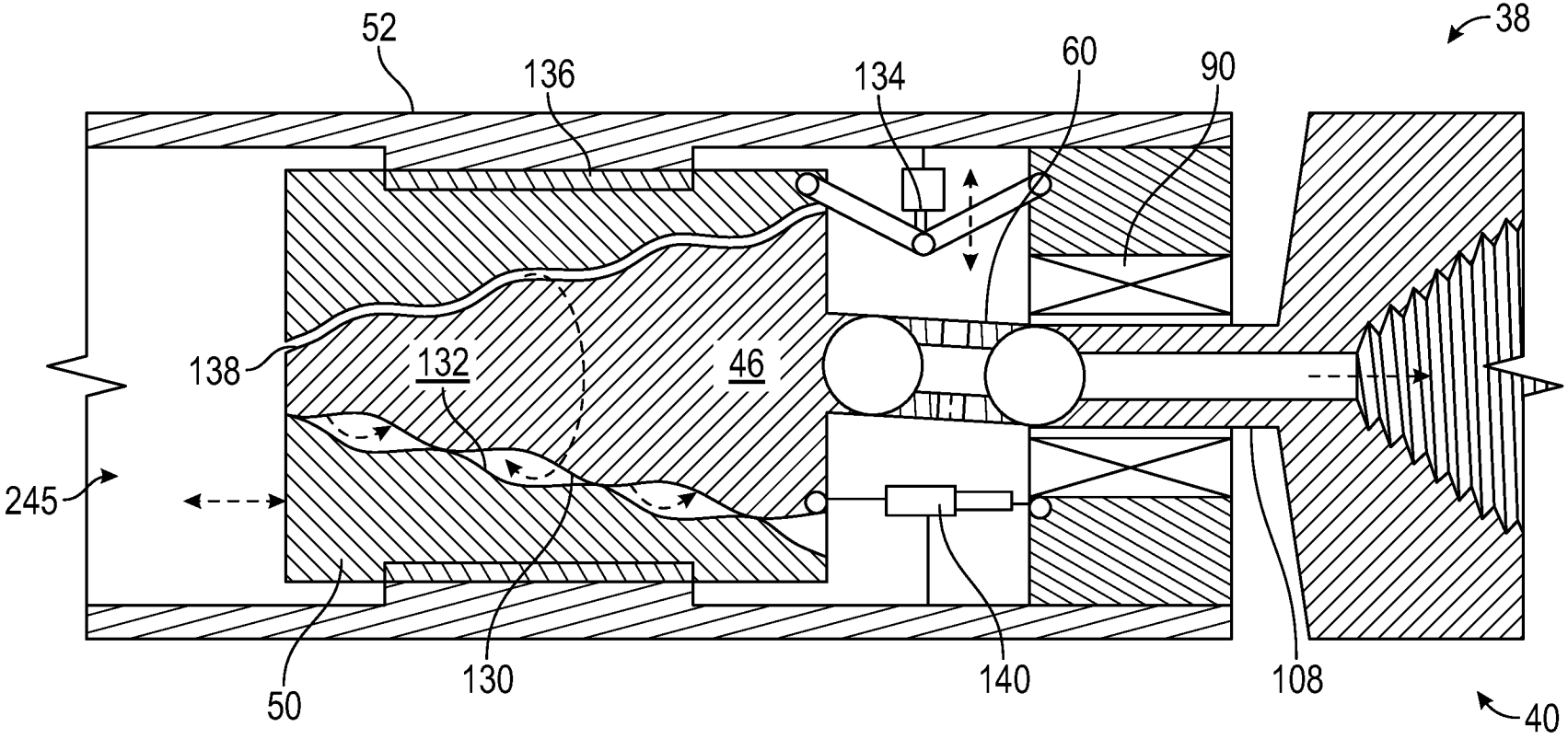
FIG. 10 illustrates an embodiment of a mud motor having a tapered profile and actuators configured to control a gap between a rotor and a stator of the mud motor.

Some embodiments of the mud motor with a tapered profile may have an actuation control system 38 as illustrated in FIG. 10. The actuation control system 38 may be configured to control the relative axial position of a tapered rotor 46 and a tapered stator 50. The actuation control system 38 may control the interface between a generally tapered outer surface 130 of the rotor 46 and a corresponding tapered interior surface 132 of the tapered stator 50. The tapered surfaces enable adjustment of the distance between the stator 50 and the rotor 46 by relative axial displacement. For example, a first differential displacement actuator 134 may be coupled between stator 50 and a portion of a collar 52 to selectively move the stator 50 along an axial sliding bearing 136. In some embodiments, a second differential displacement actuator 140 may be coupled between the rotor 46 and bearings 90 of the mud motor. Additionally, or in the alternative, splines on a shaft of the rotor 46 opposite the transmission shaft 60 may facilitate axial movement of the rotor 46 relative to the stator 50. The differential displacement actuators 134, 140 may include a variety of mechanisms, such as hydraulic piston actuators, electric actuators, e.g. solenoids, or other suitable actuators which may be selectively actuated to adjust a gap 138 between rotor 46 and stator 50.

The tapered surfaces 130, 132, in cooperation with one or both of the differential displacement actuators 134, 140, enable active adjustment of this fit and optimization of mud motor operation. For example, changes in gap 138 due to wear or other factors may be compensated and/or optimization of the gap 138 may be continually adjusted during operation of the mud motor. The gap 138 may be increased to reduce the fit and narrow the pressure differential between the top end and the bottom end, as discussed above. Alternatively, the gap may be reduced to increase the fit and widen the pressure differential between the top end and the bottom end of the mud motor. This control of the gap 138 via the actuation control system 38 may facilitate a desired fit with nominally matched rotor 46 and stator 50 components that may otherwise provide less efficient performance or greater wear. Various sensors may be employed to determine an appropriate adjustment of the gap 138 by measuring parameters such as flow, torque, differential pressure, and/or other parameters. The measured parameters may then be compared with specified motor performance curves. By way of example, the comparison may be performed on a processor-based system located downhole or at a surface location to determine appropriate control signals for driving the differential displacement actuators 134, 140 to adjust gap 138.

As described above, the pitch of the stator and the pitch of the rotor may be covariables in relationship to the axial position and taper of the mud motor components. In some embodiments, the pitch of the stator and the pitch of the rotor may vary linearly, such that the difference between the sub-pitches of adjacent lobes of the stator is a constant Δ, and the difference between the sub-pitches of adjacent lobes of the rotor is the constant Δ. The stator pitch and rotor pitch may be defined by the equations below:

$$\text{Pitch}_{stator}(t)=(A+\Delta*t)*Z_{stator}$$

$$\text{Pitch}_{rotor}(t)=(A+\Delta*t)*Z_{rotor}$$

where $Z_{stator}$ is the number of stator lobes, $Z_{rotor}$ is the number of rotor lobes, A is a constant to determine the initial pitch at the top end of the mud motor, Δ is a constant pitch increase or pitch decrease along the mud motor axis, and t is the number of stator pitches. Accordingly, the stator pitch and the rotor pitch may both be based on the constants A and Δ. As discussed above, the pitch and the taper of the mud motor may be selected to affect the volume of the cavities that are formed and progressed along the length of the mud motor. In some embodiments, the pitch and the taper may be controlled to maintain a constant cavity volume along the mud motor despite downhole operating conditions (e.g., temperature, pressure, torque). In some embodiments, the pitch and the taper may be controlled to increase the cavity volume along the mud motor to narrow a pressure differential between the top end and the bottom end of the mud motor. Increasing the cavity volume along the mud motor may reduce the heat build-up of the mud motor components, increase the fatigue life of the elastomeric stator liner, and increase the pressure rating of the mud motor. In some embodiments, the pitch and the taper may be controlled to decrease the cavity volume along the mud motor. This may increase a pressure differential between the top end and the bottom end of the mud motor. The foregoing description, for purpose of explanation, has been described with reference to specific embodiments. However, the illustrative discussions above are not intended to be exhaustive or to limit the invention to the precise forms disclosed. Many modifications and variations are possible in view of the above teachings. Moreover, the order in which the elements of the methods are illustrated and described may be re-arranged, and/or two or more elements may occur simultaneously. The embodiments were chosen and described in order to best explain the principals of the invention and its practical applications, to thereby enable others skilled in the art to best utilize the invention and various embodiments with various modifications as are suited to the particular use contemplated.

What is claimed is:

1. A mud motor comprising:

a rotor comprising one or more rotor lobes extending helically and defining a rotor pitch;

a stator comprising two or more stator lobes extending helically and defining a stator pitch;

wherein the rotor and the stator together define a tapered profile of the mud motor that varies proceeding from a top end of the mud motor to a bottom end of the mud motor;

wherein the rotor pitch and the stator pitch vary as proceeding from the top end of the mud motor to the bottom end of the mud motor; and wherein the mud motor has a pressure differential between the top end and the bottom end that is consistent between the top end and the bottom end; and wherein the rotor and the stator define a plurality of cavities, wherein rotation of the rotor within the stator is configured to progress each cavity of the plurality of cavities from the top end of the mud motor to the bottom end of the mud motor, and a volume within each cavity of the plurality of cavities varies less than 1% between the top end of the mud motor and the bottom end of the mud motor.

2. The mud motor of claim 1, wherein the tapered profile narrows from the top end of the mud motor to the bottom end of the mud motor.

3. The mud motor of claim 2, wherein a major rotor diameter of the rotor at the bottom end of the mud motor is less than a major rotor diameter of the rotor at the top end of the mud motor, and a major stator diameter of the stator at the bottom end of the mud motor is less than a major stator diameter of the stator at the top end of the mud motor.

4. The mud motor of claim 1, wherein the rotor and the stator define a plurality of cavities, wherein rotation of the rotor within the stator is configured to progress each cavity of the plurality of cavities from the top end of the mud motor to the bottom end of the mud motor, and a volume within each cavity of the plurality of cavities is configured to increase between the top end of the mud motor and the bottom end of the mud motor.

5. The mud motor of claim 1, wherein the rotor pitch and the stator pitch increase from the top end of the mud motor to the bottom end of the mud motor.

6. The mud motor of claim 1, wherein the rotor pitch and the stator pitch vary as proceeding from the top end of the mud motor to the bottom end of the mud motor as covariables with the tapered profile.

7. The mud motor of claim 1, wherein the rotor pitch and the stator pitch decrease from the top end of the mud motor to the bottom end of the mud motor.

8. The mud motor of claim 1, wherein the rotor pitch and the stator pitch vary linearly.

9. The mud motor of claim 1, wherein the rotor pitch and the stator pitch vary non-linearly.

10. The mud motor of claim 1, wherein the rotor and the stator define a plurality of cavities, wherein rotation of the rotor within the stator is configured to progress each cavity of the plurality of cavities from the top end of the mud motor to the bottom end of the mud motor, and a volume within each cavity of the plurality of cavities is configured to decrease between the top end of the mud motor and the bottom end of the mud motor.

* * * * *